US005634418A

United States Patent [19]

Price et al.

[11] Patent Number: 5,634,418

[45] Date of Patent: Jun. 3, 1997

[54] NEEDLE CHUCK WITH PIVOTING CENTER KNIFE

[75] Inventors: Elvin C. Price, Dacula; Preston B. Dasher; Erie G. Huddleston, both of Lawrenceville, all of Ga.

[73] Assignee: Atlanta Attachment Company, Lawrenceville, Ga.

[21] Appl. No.: 504,445

[22] Filed: Jul. 20, 1995

[51] Int. Cl.[6] ..... D05B 3/06

[52] U.S. Cl. ..... 112/475.09; 112/68; 112/129

[58] Field of Search ..... 112/129, 68, 66, 112/226, 122.1, 125, 122, 128, 475.09

[56] References Cited

U.S. PATENT DOCUMENTS

| | | | |
|---|---|---|---|
| 2,573,359 | 10/1951 | Rich | 112/65 |
| 2,581,046 | 1/1952 | Rich | 112/68 |
| 2,620,759 | 12/1952 | Pantusco et al. | 112/68 |
| 3,361,098 | 1/1968 | Seaman | 112/68 |
| 3,440,982 | 4/1969 | Seaman | 112/68 |
| 3,747,545 | 7/1973 | Nicolay et al. | 112/68 |
| 5,373,798 | 12/1994 | Price et al. | 112/264 |
| 5,555,834 | 9/1996 | Bonner | 112/129 |

OTHER PUBLICATIONS

Atlanta Attachment Company Advertisement "Set-In Pockets" Model 1800P.

Brother "Instruction Manual" BAS-610, 611, 612, 4 pages.

The Reece Corporation "Series 42 Welting Machine Service Manual" 1974, 3 pages.

*Primary Examiner*—Paul C. Lewis

*Attorney, Agent, or Firm*—Thomas, Kayden, Horstemeyer & Risley

[57] ABSTRACT

A cloth cutter attachment (11) is mounted to a conventional double needle sewing machine (10) for shifting a cutter assembly mount (27) fore and aft past the needle mount assembly (26) of the sewing machine (10) so that its cutting blade (76) shifts between cutting positions ahead of and behind the double needles (17) of the sewing machine (10). The cloth cutter attachment (11) allows a cut (161) to be made in a cloth material between the two rows of stitches (158,159) sewn by the double needles (17) for forming a set-in pocket.

11 Claims, 6 Drawing Sheets

NEEDLE CHUCK WITH PIVOTING CENTER KNIFE

FIELD OF THE INVENTION

This invention pertains to an attachment for a sewing machine for mounting a pair of parallel sewing needles to a needle bar with a cloth cutter positioned between the needles. More particularly, the invention comprises a sewing machine cloth cutter attachment that includes a pair of sewing needles and a cutter blade assembly movable to positions in front of and behind the sewing needles in order to cut the work product between the parallel fines of stitching at positions forward or rearward of the stitches as the stitches are being formed by the needles.

BACKGROUND OF THE INVENTION

In the manufacture of various types of garments, it is sometimes desirable to provide a pocket at a location on the garment where no seam exists. Such a pocket is commonly referred to as a "set-in" pocket. For example, in the manufacture of tubular knit pants, a seam is created down the front and back of the pants, but the sides of the pants, where pockets typically are provided, are seamless. Other types of garments requiring a set-in pocket may be hooded sweat shirts, sweat pants, placket front shirts, and slacks.

One method for sewing a pocket at a seamless position on a garment is to overlay a pocket piece of material onto the garment material, sew two parallel rows of stitches through both of the materials, and cut the two overlying materials between the two rows of stitches. The resulting stitched and cut overlying materials can then be everted and formed into a pocket with a few additional sewing operations. In the past, the cutting step of such a method typically was a manual operation, and as a result sometimes required the production of low-cost garments with set-in pockets to be carried out in third world countries where labor is inexpensive. However, cloth cutting attachments for double needle sewing machines have been devised that, in conjunction with the sewing needles, automatically stitch and cut the overlying pieces between the lines of stitching in one operation.

Prior cloth cutter attachments such as U.S. Pat. No. 2,581,046 include a cutter blade that is carried by the reciprocating needle bar of the sewing machine and is pivotable so as to first cut the cloth ahead of the stitches being formed at the beginning of the lines of stitching and later is pivoted to cut the cloth behind the stitches being formed at the ends of the lines of stitching. Such cloth cutter attachments have included a non-reciprocating lever for changing the position of the cutter, and holding the cutter in its position after movement. These early prior art cloth cutter attachments typically have required complex systems for moving the cutter between its cutting positions, and generally are relatively slow and cumbersome in operation. Therefore, the garments on which these prior art devices are used usually are relatively expensive due to its increased production time.

Recently, cloth cutter attachments have been developed that are slidably mounted upon the needle chuck of the reciprocating needle bar of the sewing machine and have an actuator mounted to the sewing machine frame or housing. For example, U.S. Pat. No. 5,373,798 discloses a cloth cutter attachment for a sewing machine that includes a needle chuck mounted to the reciprocating needle bar of the sewing machine, and to which the needles of the machine are mounted. A cutting blade assembly is slidably received within a slotted opening formed through the needle chuck and includes a cutting blade that extends downwardly through the chuck from a sliding support bar positioned between the needles. The cutting blade support bar is moved longitudinally along the slot formed in the needle chuck, to move the cutting blade between curing positions ahead of and behind the sewing needles.

A problem with such sliding cloth cutter attachments typically has been that the size of the needle chuck necessary to accommodate the sliding cutter support bar requires the sewing machine to be modified so that the needle chuck can be mounted in a position so as not to interfere with the raising of the presser foot and other operating mechanisms of the sewing machine. This higher mounting of the prior art cloth cutter attachments further requires that longer sewing needles be used, instead of standard length needles. Such longer needles tend to deflect or bend during stitching and thus the lines of stitching being sewn in the cloth can be off-centered or formed inaccurately.

Additionally, the size of such prior art designs generally has limited their use to or sewing gauges of one-quarter inch or less to avoid engagement of the presser foot by the knife mechanism, thus limiting the size of the pocket openings that can be formed in the cloth. A further problem with prior art cloth cutter attachments has been knife crashes. With previous designs, if the knife was not exactly aligned in the proper cutting position, the action of the sewing machine could cause the knife to drift slightly and become caught or bent and thus broken, or cause the fabric or cloth being sewn to be frayed or damaged. As a result, the cloth being sewn potentially would have to be discarded or fixed during later sewing operations, and the knife blades frequently have to be replaced.

Accordingly, it can be seen that a need exists for a cloth cutter attachment for a sewing machine for forming cut pocket openings in garments that is automatically actuatable so as to move from a cutting position in front of the sewing needles to a cutting position rearward of sewing needles without the knife becoming caught or bent, and which can be used with a standard sewing machine and standard length sewing needles without requiring modification of the sewing machine to accommodate the cloth cutter attachment.

SUMMARY OF THE INVENTION

Briefly described, the present invention comprises a cloth cutter attachment for a sewing machine. The cloth cutter attachment includes a needle chuck mounted on the reciprocatable needle bar of the sewing machine and a pair of spaced parallel needles extending downwardly from the needle chuck which sew two parallel lines of stitches while the cloth cutter attachment cuts the sewn fabric between the two lines of stitches. To produce the number of stitching operations necessary for ultimately producing a set-in pocket it is desirable for the lines of stitching to be of greater length than and to overlap the ends of the cut portion of the material. This allows the ends of the pocket to be bar tacked with a simple stitching operation to provide stitching completely around the pocket opening cut in the fabric by the cloth cutter attachment.

The cloth cutter attachment includes a cutting blade that is pivotally mounted to the needle chuck of the sewing machine by a cutter assembly mount. The cutter assembly mount includes an open ended yoke having a pair of upwardly extending parallel side walls spaced from one another and connected at their lower edges by a laterally extending connector bar. The side walls of the yoke are pivotally mounted to the needle chuck with the side walls of the yoke straddling the sides of the needle chuck. A blade support bar extends from the connector bar in a plane parallel to and between the side walls of the cutter assembly, between the sewing needles and supports a downwardly extending cutting blade with the cutting blade positioned between the spaced sewing needles and aligned with the sewing path.

To create a cut pocket opening in the layers of cloth passing through the sewing machine, with the opening being shorter in length than the lines of stitching, it is necessary to move the cutting blade longitudinally with respect to the double needles. The present invention accomplishes the longitudinal movement of the cutting blade by the pivoting movement of the yoke of the cutting assembly mount about the needle chuck. An actuator is mounted to the sewing machine frame adjacent the cloth cutter attachment for intermittently engaging the cloth cutter attachment to shift the yoke of the cutting assembly mount, and thus the cutting blade, forwardly and rearwardly between a first cutting position in front of the double needles and a second cutting position rearward of the cutting needles, in a controlled manner to produce the desired stitching and cutting operation.

The actuator means includes a cutting blade retracting linkage having an indexer lever pivotally mounted to the sewing machine frame. A pusher plate is mounted to a second or free end of the indexer lever, positioned to engage the yoke of the cutting assembly mount. The pusher plate generally is a substantially triangularly shaped plate having an angled front surface and a substantially straight rear cam surface. Generally, at the start of a sewing operation, the pusher plate is positioned at an angle in front of and slightly above the yoke and is moved in a substantially arcuate motion rearwardly into engagement with the yoke to move the cutting blade between its first and second cutting positions.

A first air cylinder is mounted to the sewing machine frame for moving the retracting linkage. The first air cylinder includes a piston rod that is connected to the first end of the indexer lever of the retracting linkage. As the piston rod of the first air cylinder is retracted, the pusher plate is pivoted into engagement with the yoke of the cloth cutter attachment so as to cause the yoke to be pivoted rearwardly with respect to the needle chuck. As a result, the cutting blade is repositioned from its first cutting position forward of the sewing needles to its second cutting positioned rearwardly of the sewing needles relative to the advancement of the piece of cloth towards the needles.

The actuator means further includes a cutting blade advancing linkage that is pivotally mounted to the sewing machine frame above the needle chuck. The advancing linkage includes an indexer finger that depends from the forward end of the linkage in a position to engage the yoke of the cutting assembly mount. A second cylinder is mounted to the sewing machine frame and includes a piston rod connected to the rearward end of the advancing linkage. As the second air cylinder extends its piston rod, the indexer finger is advanced into engagement with and urges the yoke to pivot forwardly with respect to the needle chuck. As a result, the cutting blade is repositioned from its second, rearward cutting position to its first, forward cutting position. Typically, at the same time that the advancing linkage is being engaged, the retracting linkage is detracted so as to move the pusher plate of the retracting linkage forwardly and out of the way of the yoke as the yoke is moved to its forward position.

A means for releasably securing the cutting assembly mount in its first and second cutting positions is mounted within the needle chuck and is adapted to engage the side walls of the yoke of the cutting assembly mount. The means for securing generally includes a spring loaded ball and detent means that includes a spring received through an opening formed in the needle chuck adjacent a lower edge thereof, and balls mounted at either end of the passage within which the spring is received. The spring tends to bias the balls outwardly from the sides of the needle chuck. The sidewalls of the yoke each include a pair of spaced apertures or bores formed adjacent the lower edges of the sidewalls. The apertures are positioned so as to be engaged by the balls of the ball detent means when the cutting blade is in its first or second cutting positions. The engagement of the balls with the apertures of the yoke retards the pivotal movement of the yoke under general cutting conditions, to hold the yoke in its forward or rearward positions during a cutting and stitching operation. The holding force of the ball detent means is overcome by the action of the retracting and advancing linkages so as to disengage the yoke from the ball detent means and enable the yoke to be pivoted about a substantially horizontal pivot axis to move the cutting blade between its first and second cutting positions.

In addition, the controls for the cloth cutter attachment include an adapter cable that is connected to the sewing machine control box and the solenoid cable leading to the sewing machine. Such connection provides a simple means for integrating the cloth cutter attachment controls with the sewing machine controls to enable ease of use by an operator.

Thus, it is an object of the present invention to provide an improved cloth cutter attachment for double needle sewing machine for forming a set-in pocket in a garment.

Another object of the invention is to provide an improved apparatus for forming a set-in pocket for a garment that includes a cutting blade that can be pivoted between a first cutting position forward of the sewing needles and a second cutting position rearward of the sewing needles to form a cut pocket opening between parallel lines of stitching formed by the sewing needles.

Another object of the invention is to provide an improved cloth cutter attachment for forming a cut opening in a garment, or other work product, which includes a moveable cutting blade and an actuator means that is mounted to the sewing machine frame externally of the reciprocating needle bar of the sewing machine for moving the cutting blade fore and aft with respect to the needle bar.

Another object of the present invention is to provide an improved cloth cutter attachment for a double needle sewing machine that is capable of being mounted to a standard double needle sewing machine without modification of the sewing machine and which can be used with standard length sewing needles.

Another object of the present invention is to provide an improved cloth cutter attachment for forming a set-in pocket that can be used with sewing needles of varying width gauges to enable a wider range of sewing gauges to be used for forming the cut pocket opening.

Another object of the present invention is to provide an improved cloth cutter attachment that is adapted to mount about a needle chuck for a double needle sewing machine and having a cutting blade that is received between the needles which are mounted to the needle chuck, with the cutting blade being moveable during the sewing function to positions ahead of and behind the positions where the stitches are being formed in the work product.

Other objects, features and advantages of the present invention will become apparent from the following specification, when read in conjunction with the accompanying drawings.

DETAILED DESCRIPTION OF THE PREFERRED EMBODIMENT

Figure 1:
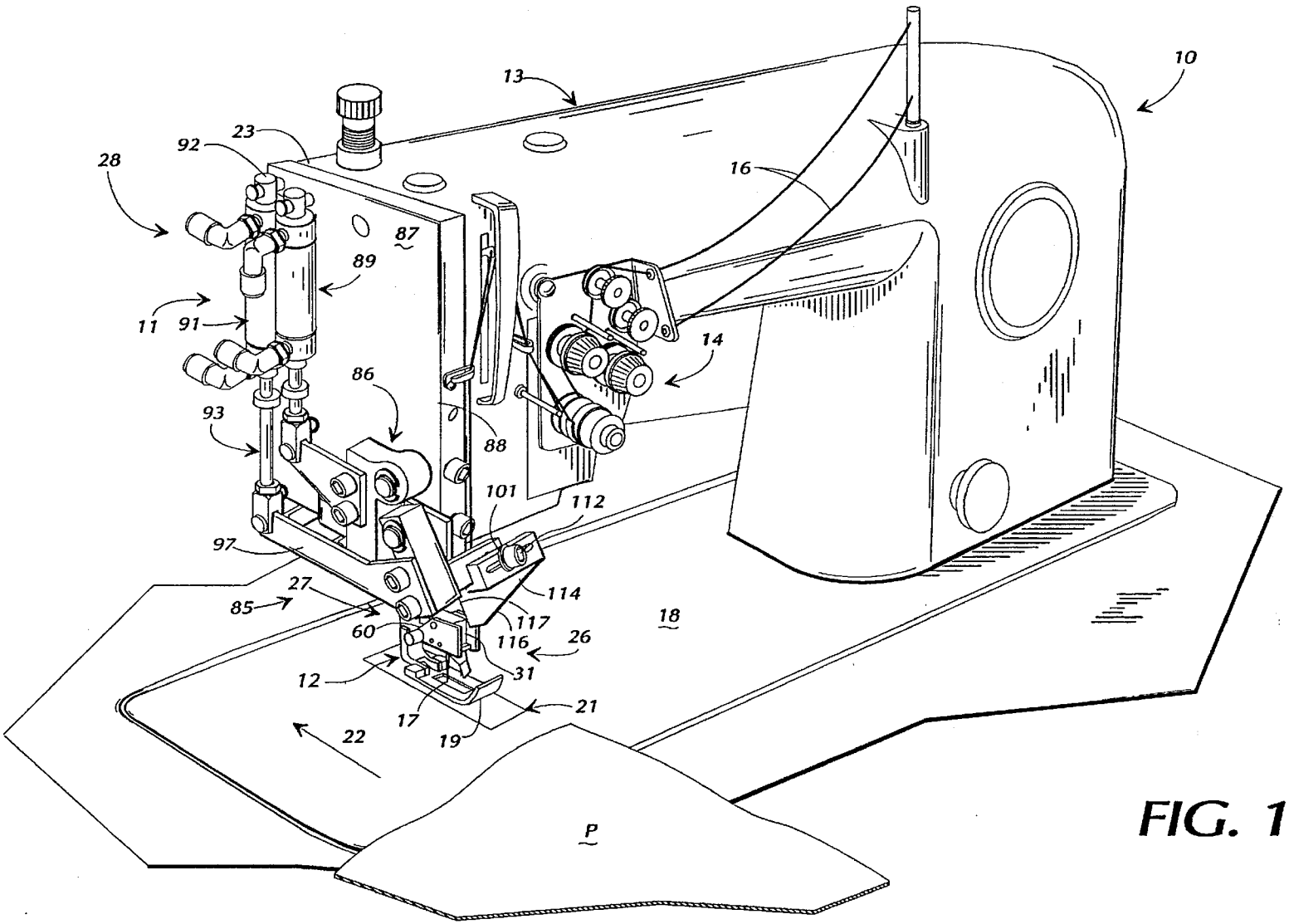
FIG. 1 is a perspective view of a conventional sewing machine with the cloth cutter attachment of the present invention attached thereto.

Referring now in greater detail to the drawings, in which like numerals indicate like parts throughout the several views, FIG. 1 illustrates a conventional sewing machine 10 having the cloth cutter attachment 11 mounted at the sewing head 12 of the sewing machine 10. The sewing machine generally is a conventional double needle sewing machine having a machine frame housing 13, and a thread guide assembly 14 mounted to the machine frame housing adjacent the sewing head 12 for guiding a series of needle threads 16 under tension to a pair of sewing needles 17 mounted to a reciprocating needle bar (not shown) at the sewing head of the sewing machine. The sewing machine 10 is mounted on a work surface 18 and further includes a presser foot 19 for slidably securing a work product P to be stitched and cut by the sewing machine with the cloth cutter attachment, and a throat plate 21 with feed dogs (not shown) mounted below and moveable up through the throat plate for advancing the work product or P along a sewing path generally indicated by arrow 22. The work product typically comprises a piece of pocket material, which is folded and sewn about its edges to form the pocket in later sewing operations, and the garment, usually one ply of material, to which the pocket is to be attached.

As FIG. 1 illustrates, the cloth cutter attachment 11 generally is mounted to a side face 23 of the machine frame housing 13 of the sewing machine 10. The cloth cutter attachment 11 generally includes a needle assembly mount 26, and a cutter assembly mount 27, and an actuator means 28 for moving the cutter mount assembly with respect to the needle assembly mount. The needle assembly mount 26 is mounted to the reciprocating needle bar (not shown) of the sewing machine 10 and includes a needle chuck 31 to which the needles 17 of the sewing machine are mounted, depending downwardly therefrom, and a mounting stud 38 (FIG. 2A) extending upwardly therefrom. The needle chuck generally is a substantially S-shaped block having a top surface 32, bottom surface 33, front surface 34, rear surface 36 and a pair of opposed substantially flat side surfaces 37. Typically, the needle chuck is formed from a metal such as steel or aluminum, although other types of lightweight, durable materials can be used as well. A mounting stud or post 38 is attached to the top surface 32 of the needle chuck, extending upwardly therefrom, and includes a threaded upper end 39 that engages and attaches to the needle bar of the sewing machine to mount the needle chuck thereto.

Figure 2A:
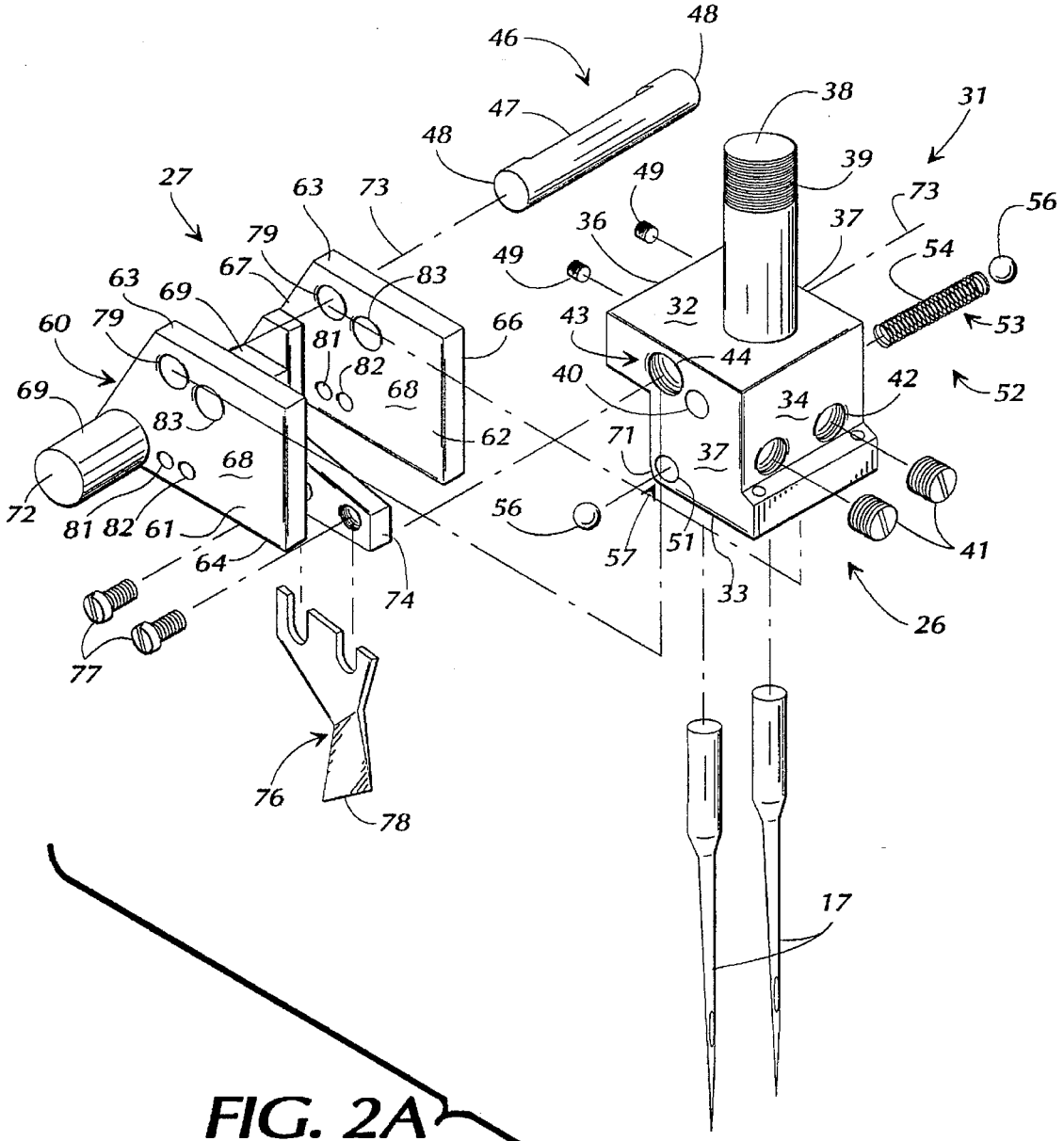
FIG. 2A is an enlarged exploded perspective view of the needle chuck and cutting assembly mount of the cloth cutter attachment shown in FIG. 1.

As FIG. 2A indicates, the needles are received through the bottom surface 33 of the needle chuck within bores (not shown) formed in the bottom surface. Set screws 41 are received through threaded openings 42 formed in the front surface 34 of the needle chuck. The set screws are tightened against the upper end of the needles to secure the upper ends of the needles within the needle chuck in a stable, secure position. An air passage 40 is formed through the needle chuck above the upper ends of the needles received within the needle chuck. An air flow can be directed through the passage 40 for cleaning dust and debris collected about the upper ends of the needles during sewing operations.

A substantially cylindrically shaped upper, first bore or passage 43 is formed in and extends through the needle chuck between the side surfaces 37 thereof, with its ends 44 being open at the side surfaces. The upper bore is formed adjacent the top surface 32 of the needle chuck 31, at a corner between the rear surface 36 and side surfaces 37 of the needle chuck. A pivot pin 46 is received through the upper bore 43. The pivot pin is substantially cylindrically shaped and includes a flat portion 47 formed intermediate its ends 48. The pivot pin is received through the upper bore 43 and is secured within the upper bore by set screws 49 inserted into the rear side surface 36 of the needle chuck, as indicated in FIG. 2A and which are tightened against the flat portion 47 of the pivot pin 46.

A second or lower bore 51 is formed through the needle chuck 31, positioned below and aligned with the upper bore 43. The lower bore 51 generally is a substantially cylindrically shaped passage, having a diameter that typically is less than diameter of the upper bore. The lower bore is formed adjacent the bottom 33 of the needle chuck, at the corner between the rear, bottom and side surfaces of the needle chuck. Generally, a securing means 52 is received within the lower bore 51. Typically, the securing means comprises a ball detent assembly 53, or similar releasable locking means, including a compression spring 54 that is received and contained within the lower bore, and balls 56 mounted at the opposite open ends 57 of the lower bore 51. The spring 54 is compressed within the lower bore so as to urge the balls 56 laterally outwardly from the sides of the needle chuck toward releasable engagement with detent means for securing the cutter assembly mount 27 in a desired orientation.

Figure 2B:
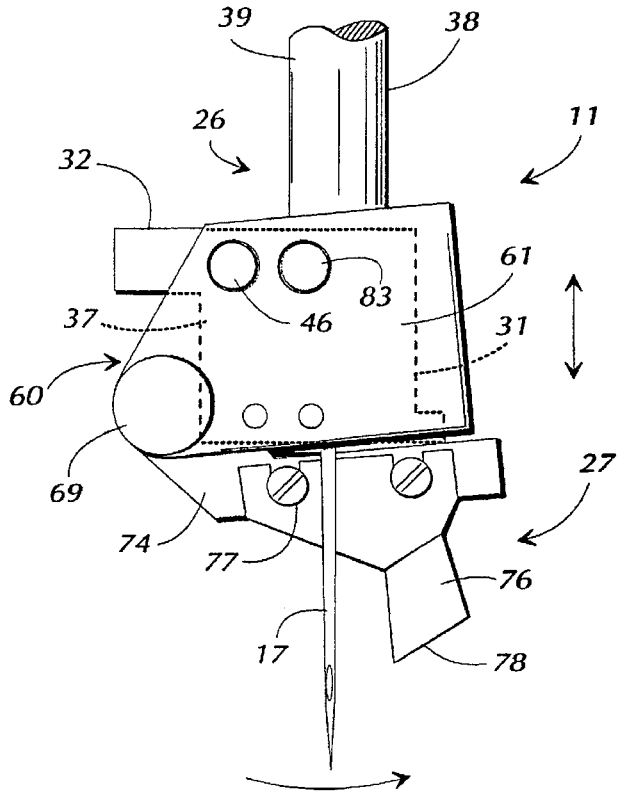
FIG. 2B is a side elevational view of the needle chuck and cutting assembly, showing the blade tilted forwardly of the needles.
Figure 2C:
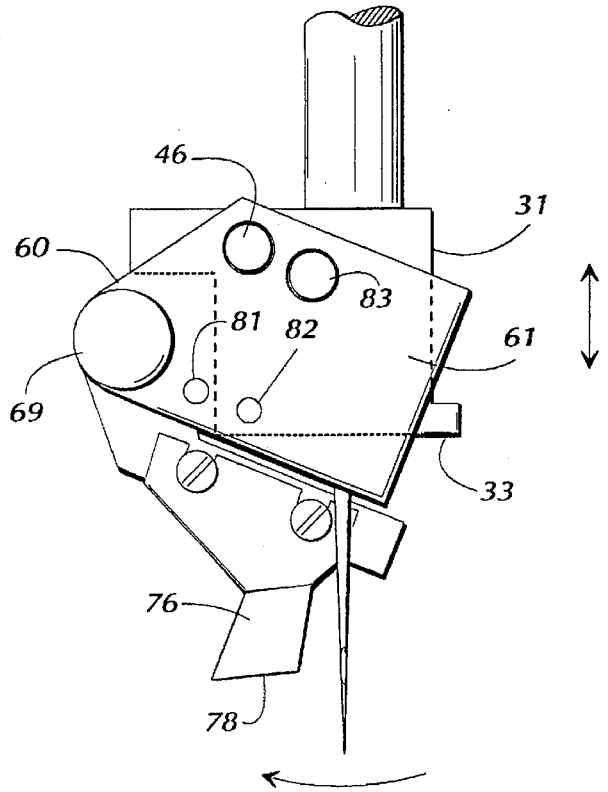
FIG. 2C is a side elevational view of the needle chuck and cutting assembly, similar to FIG. 2B, but showing the blade tilted rearwardly of the needles.

As illustrated in FIGS. 2B and 2C, the cutter assembly mount 27 of the cloth cutter attachment 11 is pivotally mounted to the needle chuck 31 of the needle assembly mount 26. The cutter assembly mount 27 includes a substantially U-shaped yoke 60 typically formed from steel, aluminum or a similar metal material, that usually is the same as the material from which the needle chuck is formed. The yoke 60 includes a pair of parallel side walls 61 and 62 each generally having a generally rectangularly shaped configuration, and each including upper, lower, front and rear edges 63, 64, 66 and 67, and vertically extending body portions 68. The side walls 61 and 62 of the yoke 60 are connected in an opposed parallel relationship by a connecting bar 69 that extends between the body portions 68 of the side wall and is mounted to the side walls adjacent a lower corner 71 of each sidewall between the lower and rear edges 64 and 67 of the sidewalls. As FIG. 2A indicates, one end of the connecting bar extends past the body of sidewall 61, so as to provide a handle or finger 72 adapted to be engaged by the actuator means 28 for pivoting the yoke about a horizontally extending pivot axis 73 that extends through the upper bore 43 of the needle chuck.

A cutting blade support bar 74 is mounted to the connecting bar 69 extending perpendicular thereto between the sidewall 61 and 62 of the yoke 60. A cutting blade 76 is mounted to the cutting blade support 74 by fasteners 77 such as bolts or screws. The cutting blade extends downwardly from the cutting blade support and is positioned between the needles 17 mounted to the needle chuck 31. As FIGS. 2A and 2C illustrate, the cutting blade includes an angled cutting edge 78 for cutting the work product P (FIG. 1).

The yoke 60 is mounted to the needle chuck 31 with the ends 48 of the pivot pin 46 (FIG. 2A) being received within parallel, opposed openings 79 formed in the sidewalls 61 and 62 of the yoke, adjacent the upper edges 63 thereof. The yoke is supported on the ends of the pivot pin and thus is pivotable with respect to the needle chuck to enable the yoke, and thus the cutting blade supported by the yoke, to be moved fore and aft, to desired cutting positions behind and ahead of the needles 17 as indicated in FIGS. 2B and 2C. Additionally, a pair of small apertures 81 and 82 are formed in each of the side walls 61 and 62 (FIG. 2A) adjacent their lower edges 64. The apertures are arranged in a spaced relationship with aperture 82 formed slightly higher above the lower edges of the sidewalls. The apertures are smaller than the balls 56 and function as detents when engaged by the balls 56 of the ball detent assembly 53 in order to releasably lock the yoke position, and thus the cutting blade 76, in a first or forward cutting position, with the cutting blade positioned in front of the needles 17, and in a second or rearward cutting position, with the cutting blade position behind the needles. Air passage openings 83 also are formed in each of the side walls of the yoke, and are aligned with the air passage 40 extending through the needle chuck when the yoke is positioned about the needle chuck. The air passage openings enable a flow of air to be applied through the air passage for cleaning collected dirt and debris from about the upper ends of the needles.

Figure 3:
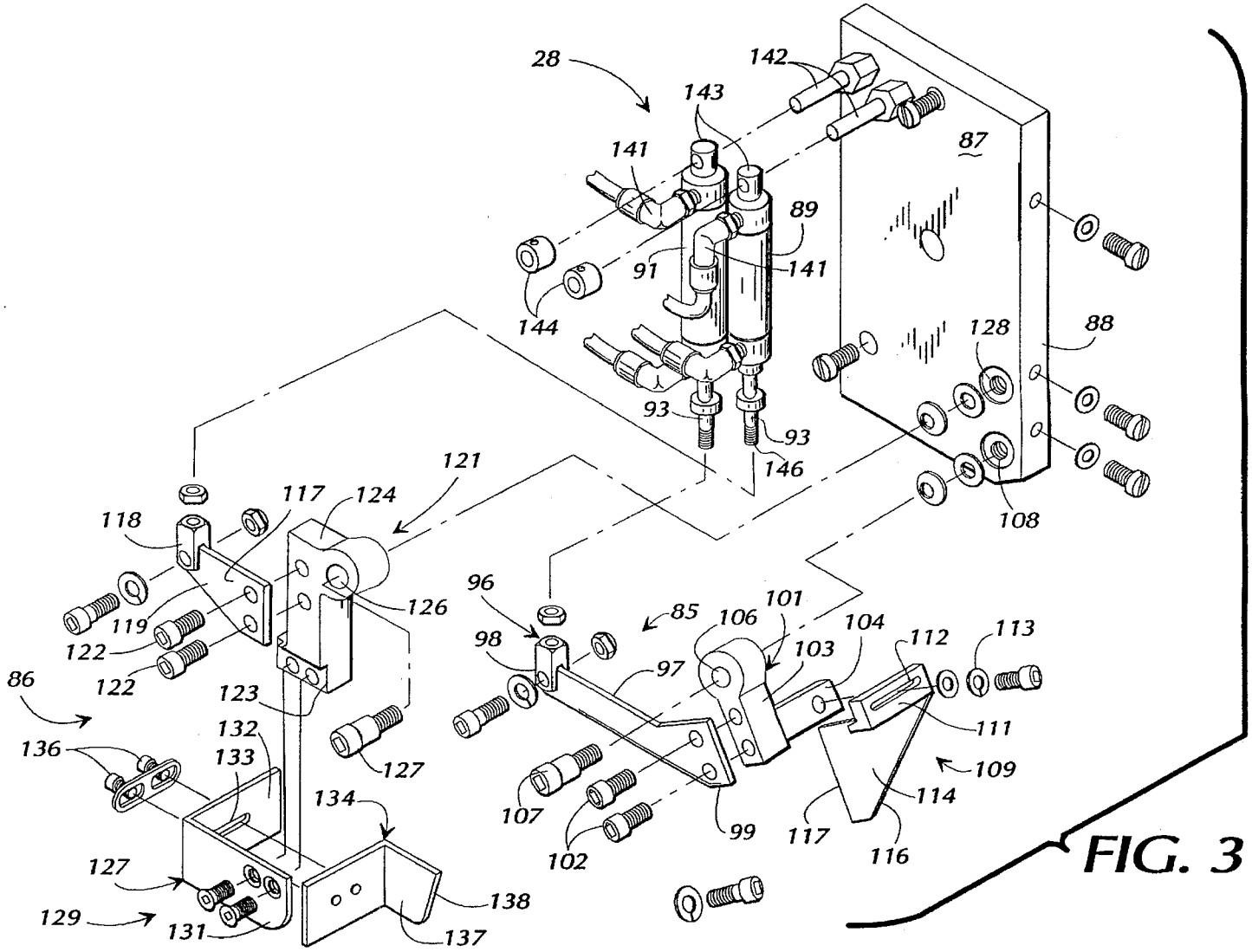
FIG. 3 is an enlarged exploded detailed view of the actuator means of the cloth cutter attachment shown in FIG. 1.
Figure 4:
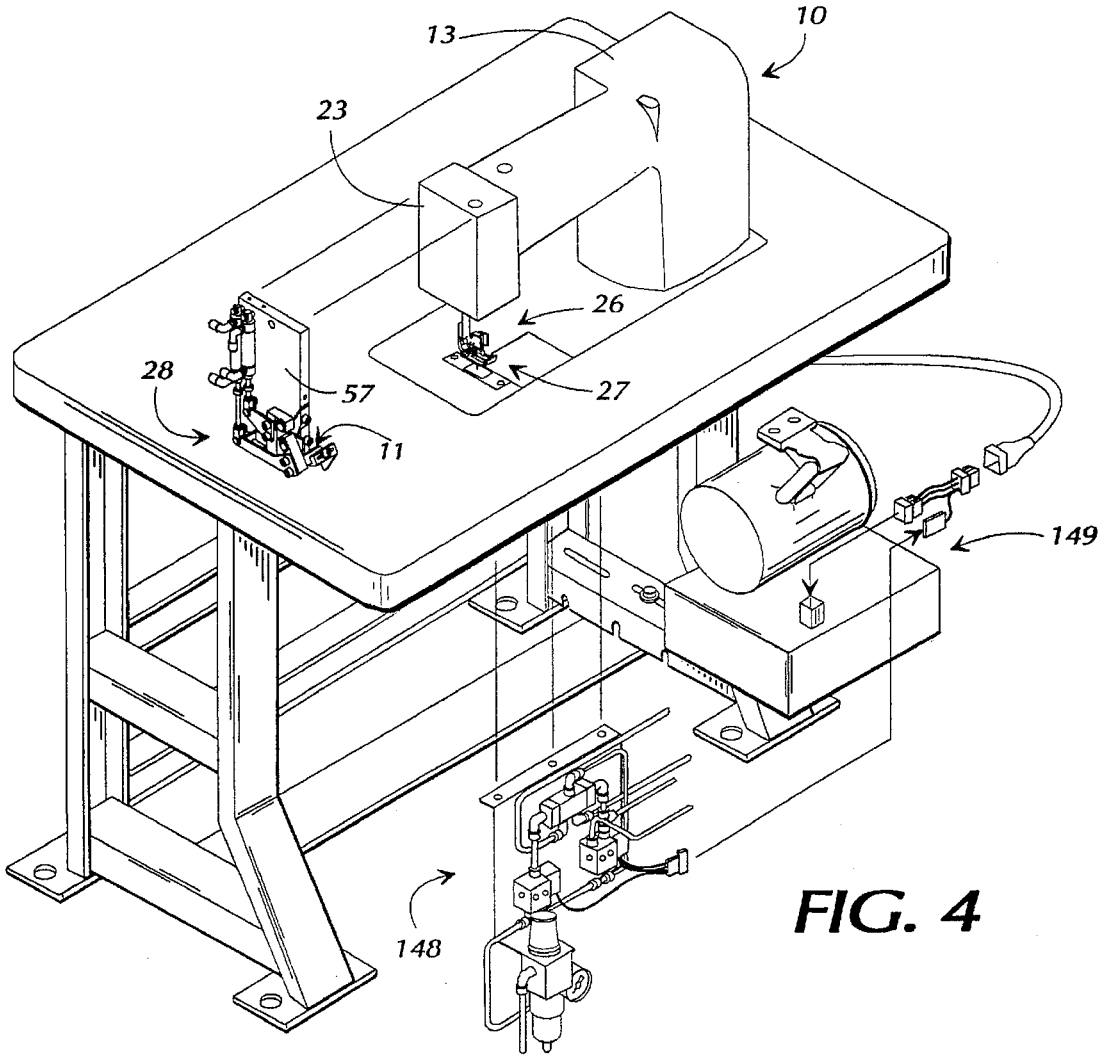
FIG. 4 is a partially exploded view of the actuator means for the cloth cutter attachment shown in FIG. 1, and the control means for the cloth cutter attachment, which is connected to the control system of the sewing machine.

FIG. 3 is an exploded perspective view of the actuator means 28 for moving the cutting blade between its first and second cutting position. The actuator means 28 generally comprises of a cutting blade retracting linkage 85 for pivoting the cutting blade rearwardly of the sewing needles with respect to the oncoming piece of cloth, and an advancing linkage 86 for pivoting the cutting blade forwardly ahead of the sewing needles with respect to the oncoming piece of cloth to move the cutting blade between its first and second cutting position. A substantially flat support plate 87 is mounted to the sewing machine frame housing 13, as shown in FIG. 4, for supporting the actuator means in a position adjacent the sewing needles. The advancing and retracting linkages 85 and 86 are pivotally mounted to the support plate 87 adjacent a front edge 88 thereof. The first and second air cylinders 89 and 91 are mounted to the support plate adjacent a rear edge 92 of the support plate and each include a piston rod 93 adapted to engage and move the retracting and advancing linkages through their pivoting movements.

The cutting blade retracting linkage 85 comprises a clevis 96 that is pivotally secured to an indexer lever 97. The indexer lever 97 generally is an elongated substantially rectangularly shaped bar or strip having a first end 98 to which the clevis 96 is attached and a second end 99 is spaced from the first end 98. A substantially L shaped indexer pivot 101 is secured to the second end 99 of the indexer lever 97 by fasteners such as capscrews 102. The indexer pivot includes a substantially vertically extending arm 103 and a substantially horizontally extending arm 104. An aperture 106 is formed in through the upper end of the vertical arm 103 of the indexer pivot, through which a fastener 107, such as a capscrew or pivot pin, is received to pivotally attach the upper end of the indexer pivot to the support plate 87. As FIG. 3 illustrates, a first pivot opening 108 is formed in the support plate and receives the fastener 107 therein for attaching the indexer pivot, and thus the retracting linkage, to the support plate.

An indexer slide 109 is mounted to the horizontal arm 104 of the indexer pivot 101. The indexer slide includes a substantially L shaped horizontally extending arm 111 having a slot 112 formed therethrough. The horizontal arm 111 is matched to the horizontal arm 104 of the indexer pivot, and a fastener 113 is received through the slots 112 thereof to mount the indexer slide to the indexer pivot. The mounting of the fastener 113 along the slot 112 enables the indexer slide to be moved laterally through just the position thereof with respect to the indexer pivot. An angled pusher plate 114 projects downwardly from one end of the arm 111 and includes an angled front surface 116 and a downwardly extending rear cam surface 117. The rear cam surface 117 of the pusher plate is adapted to engage the outwardly projecting finger portion 72 (FIG. 2A) of the connecting bar 69 of the cutter assembly mount 27 (FIG. 2) for moving the cutting blade to its second or rearward cutting position.

As shown in FIG. 3, the advancing linkage 86 includes a clevis 118 pivotally secured to an indexer lever 119 at a first end thereof. An indexer arm 121 is mounted to the opposite end of the indexer lever by a pair of fasteners 122, such as capscrews or bolts. The indexer arm 121 has a slightly Z-shaped configuration having a lower end 123 and an upper end 124 having an aperture or bore 126 formed through its upper end at a front edge thereof. A fastener 127, such as a pivot pin is received therethrough and engages a second pivot opening 128 formed in the support plate 87, positioned adjacent first pivot opening 108, to pivotally attach the advancing linkage to the support plate. A substantially L-shaped finger bracket 129 is mounted to the lower end 123 of the indexer arm 121 along a longitudinally extending portion 131 thereof and includes a laterally extending portion 132 positioned behind the indexer arm and having a slot 133 formed therein. An L-shaped indexer finger 134 is secured to the laterally portion 132 of the finger bracket 129 by insertion of a pair of capscrews or similar fasteners 136 along the slot 133. The mounting of the indexer finger along the slot enables the position of the indexer finger to be adjusted laterally to a position for engaging the outwardly projecting finger 72 (FIG. 2A) of the connecting bar 69 of the cutter mount assembly 27 depending on the size of the needle chuck and yoke. The indexer finger includes a forwardly extending portion 137 (FIG. 3) having an angled front cam surface 138 adapted to engage the projecting end of the connecting bar of the cutter assembly mount for moving the cutting blade 76 (FIG. 2B) to its first or forward cutting position.

As FIG. 3 illustrates, air cylinders 89 and 91 each include pneumatic connections 141 that lead to an air supply into the controls for the actuator means 28. Each of the air cylinders is mounted to the support plate 87 by dowel pins 142 that are inserted through mounting cylinders 143 with collars 144 placed about the ends thereof and secured with set screws (not shown). Each of the piston rods 93 of the air cylinders is extensible downwardly from its air cylinder and each has a threaded end 146 for securing the piston rods to the clevises 96 and 118 of the retracting linkage 85 and advancing linkage 86, respectively.

As shown in FIG. 4, the cloth cutter attachment 11 is mounted to a side face 23 of the sewing machine frame housing 13, with the needle mount assembly end 26 and cutter mount assembly 27 being mounted to the reciprocating needle bar (not shown) of the sewing machine. A control assembly 148 is connected to the cloth cutter attachment and is adapted to receive compressed air from a pneumatic air source (not shown) and connects the cloth cutter attachment to the sewing machine controls 149. Control assembly 148 generally includes a conventional solenoid control that is designed to be actuatable in conjunction with the sewing machine controls or ease of operation.

Figure 7A:
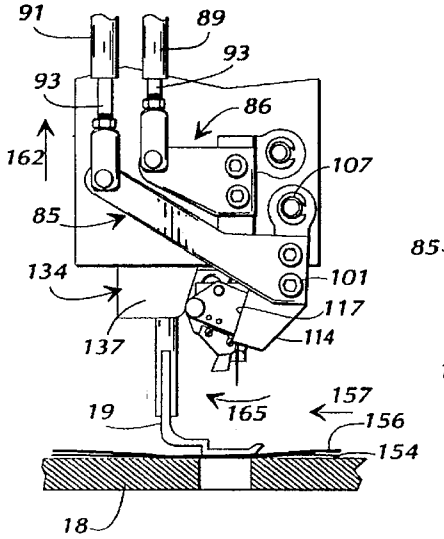
Figure 7B:
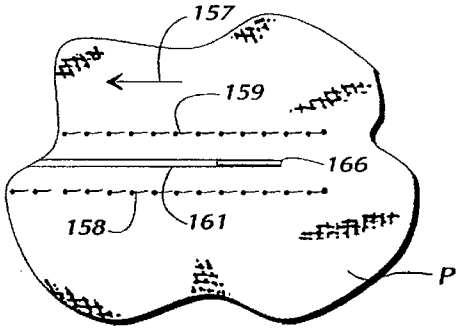
Figure 6A:
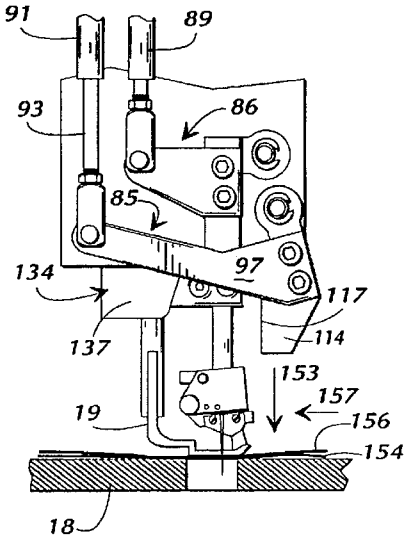
Figure 6B:
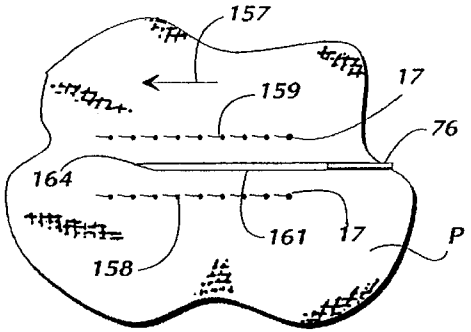
Figure 5:
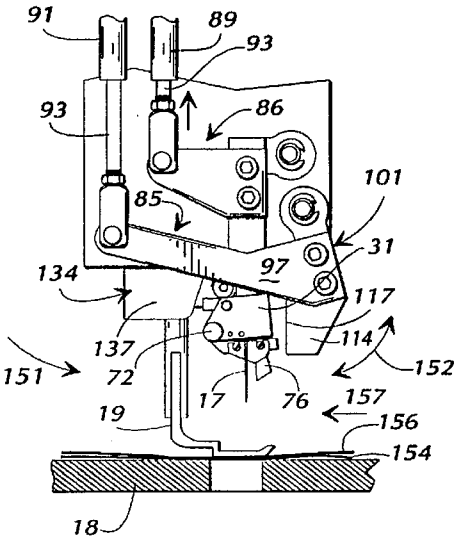

FIGS. 5, 6A, 7A and 8 are side elevation views of the cloth cutter attachment 11 illustrating the sequence of movements of the needle chuck 31, the cutting blade 76 and the actuator means 28. FIGS. 6B and 7B are diagrammatic views of the stitches and cuts made in the cloth work piece which correspond to the positions of cutting blade 76 as shown in FIGS. 6A and 7A, respectively, As shown in FIG. 5, prior to the start of the stitch and cut operation, the piston rod 93, extending from the front air cylinder 89 is retracted to pivot the advancing linkage 86 backwards, as indicated by arrow 151, so that the forwardly extending portion 137 of indexer finger 134 of the advancing linkage is in its aft or rearward position. The piston rod 93 extending from the rear air cylinder 91 is fully extended, so that indexer pivot 101 is in a forwardly extended position.

In this starting position, the cam surface 117 of the pusher plate 114 of the retracting linkage 85 is positioned outward ahead of the needle mount assembly and cutter mount assembly 27. The cutting blade 76 thus is extended in front of the needle chuck 31 as a result of the cutting blade advancing step of a prior stitch operation. The cutting blade is held in this extended position by the engagement of the balls 56 of the ball detent assembly 53 with the detents 81, 82 in the side walls 61, 62 of the yoke 60.

Thus, it will be understood that the ball detent assembly functions as a stop-means for securing the cutting blade in a desired position. In its extended forward position, the cutting blade 76 is positioned ahead of the sewing needles 17, as indicated in FIG. 5. So arranged, the stitch and cut operation for forming a set-in pocket is ready to commence.

FIG. 6A illustrates the movement of the sewing needles 17 and the cutting blade 76 toward the cloth material P as indicated by arrow 153. The cloth material comprises a garment piece 154 and an overlying pocket piece 156. The two pieces of material are held between the presser foot assembly 19 and the feed dogs mounted underneath the working surface 18 of the sewing machine and are advanced in the direction indicated by arrow 157. As shown in FIG. 6B, the cloth material P is advanced in the direction of arrow 157 and parallel lines of stitches 158 and 159 stitches are sewn behind cuts 161 made in the material by the cutting blade 76, which initially leads the sewing needles 17.

In FIG. 7A, the piston rod 93 of the second air cylinder 91 has been retracted upwards, as indicated by arrow 162, thereby pivoting the indexer pivot about pivot pin 107. The pivoting of indexer pivot 101 causes the cam surface 117 of pusher plate 114 to engage the finger 72 of the yoke as the needle mount assembly 26 reciprocates up and down causing the yoke, and thus cutting blade 76 to be pivoted rearwardly. As the cutting blade 76 is pivoted rearwardly, as indicated by arrow 165, the cutting blade 76 moves between and behind the sewing needles 17 to a second cutting position spaced from the sewing needles. The ball detent assembly 53, secures the cutting blade in this aft position. The needles stitch the cloth material ahead of the cuts 161 that the cutting blade makes in the material, as shown in FIG. 7B. The distances 164, 166 of the cutting blade in front of and behind the sewing needles is determined by the locations of and the distance between the detents and other design features of the cutter assembly mount 27 and the actuator means 28 and can be formed at varying desired distances suitable for particular applications or gauges of stitching.

Figure 8:
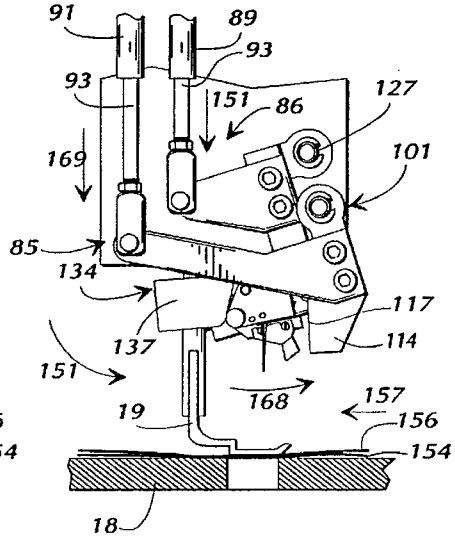
FIGS. 5–8 are a sequence of side elevational and diagrammatic views of the cloth cutter attachment of FIG. 1, illustrating the sequential movement of the cutting blade, sewing needles, and the actuator means for cutting and sewing a set-in pocket opening within a piece of cloth, and illustrating the movement of the cutting blade during a sewing operation.

FIG. 8 illustrates the positioning of the cloth cutter attachment at the end of the stitch and cut operation. After the stitch and cut is complete, the needle mount assembly is raised and the cutting blade is advanced forward into its first cutting position ahead of the sewing needles, for subsequent stitch and cut operations. To advance the cutting blade forward, the piston rod 93 of the front air cylinder 89 is extended, as indicated by arrow 151, causing the advancing linkage to pivot about pivot pin 127. Upon pivoting of the advancing linkage, the indexer finger 134 extending from the advancing linkage is pivoted forward and engages the finger 72 projecting from the yoke 60, causing the cutting blade to pivot forward, as indicated by arrow 168. The piston rod 93 of the rear air cylinder 91 is also extended in the direction indicated by arrow 169 thereby pivoting the retracting linkage to a forward position, which positions the cam surface 117 of the indexer lever forward ahead of the cutting blade.

It should be noted that the retracting linkage is released from engagement with the yoke of the cutter assembly mount as the ball detent assembly secures the yoke in its rearward position. In this manner, the cam surfaces of the pusher plate 114 and indexer finger 134 do not remain continuously in contact with the yoke, but rather intermittently engage the yoke to shift the cutting blade between its first and second cutting positions. As a result, wear and tear between the retracting and advancing linkages and the cutter blade assembly is minimal and vibration is reduced.

Figure 9:
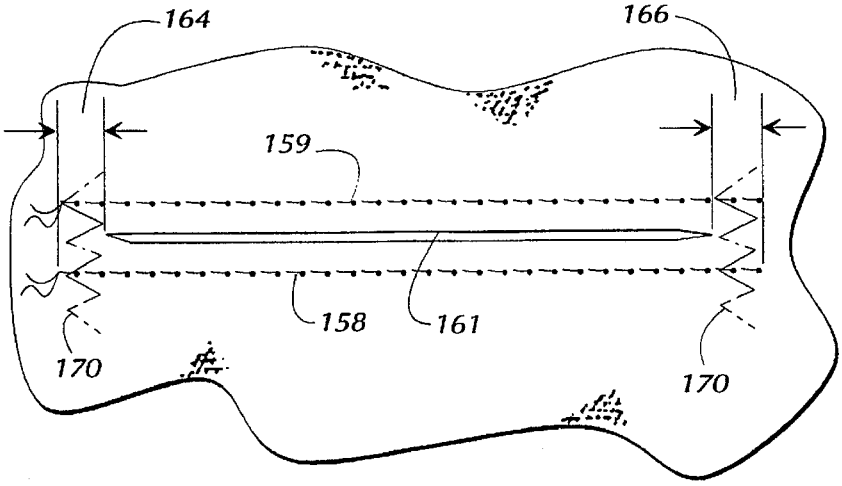
FIG. 9 is an enlarged, detailed illustration of a set-in pocket stitched and cut by the sewing machine cloth cutter attachment shown in FIG. 1.

FIG. 9 is an enlarged detailed view of the final stitch and cut pattern in the cloth material P. Two spaced lines of stitches 158, 159 are formed by the pair of sewing needles 17 and the cut 161 is made down between the lines of stitches. The off-set distances 164, 166 (FIG. 7B) between the ends of the lines of stitches and the ends of the cut correspond to the distances respectively, that the cutting blade pivots ahead of and behind the sewing needles. The off-set distances 164, 166 provide a transverse stitch area in the cloth material P for a bar tack 170 to be made perpendicular to the lines of stitches. With the ends of the stitch and cut pattern bar tacked, the cut is completely enclosed by stitching and the cloth material can subsequently be processed to finish the completed set-in pocket. Further, the design of the cloth cutter attachment enables its use in sewing gauges up to ¾ inch to enable a greater variance in pocket sizes than can be achieved with conventional cutters, which generally are limited to use for sewing gauges of ¼ inch or less due to their sizes and configurations.

Accordingly, it can be seen that the cloth cutter attachment of the present invention provides a significant advance in the art by providing a cutting attachment for forming a set-in pocket in a piece of cloth, which can be mounted to a standard double needle sewing machine without requiring modification of the sewing machine to accommodate the cloth cutter attachment. Additionally, the size and configuration of the present invention enables standard size needles to be used, minimizing the incidence of needle deflection and potential for knife crashes that can damage the cloth material and require additional sewing operations to finish sewing the pocket. Further, while the cloth cutter attachment of the present invention has been described herein in conjunction with a pair of sewing needles, it will be understood by those skilled in the art that the cutter assembly mount and the actuator means of the present invention can operate in conjunction with a single needle mounted to the needle mount assembly to produce, if desired, a single stitch and cut, Such an arrangement would also reduce vibration and increase the precision of the cutting operation.

The features and principles of the present invention have been illustrated in the foregoing description of a preferred embodiment thereof. It will be apparent to those skilled in the art that various changes of modifications may be made thereto without departure from the spirit and scope of the invention as set forth in the following claims.

We claim:

1. A sewing machine cutting attachment for cutting a pocket opening in a piece of cloth between spaced rows of stitching, adapted to mount to a sewing machine of the type having a housing, means for advancing the cloth along a sewing path, and a reciprocable needle bar, the cutting attachment comprising:

a needle chuck for mounting to the needle bar;

a pair of sewing needles mounted to said needle chuck for alignment across the sewing path;

a cutting assembly mount including a yoke pivotally attached to said needle chuck and a cutting blade attached to said yoke, said cutting blade being maintained by said yoke in alignment with the sewing path and positioned between said needles and pivotable between said needles from a first position forward of said needles along the sewing path to a second position rearward of said needles along the sewing path for cutting the cloth between the rows of stitching being formed in the cloth by said needles;

locking means mounted to said needle chuck and adapted to engage said yoke in locking engagement with said cutting blade positioned either in said first or second cutting positions; and actuator means for mounting to the sewing machine housing and for selectively moving said cutting blade between said first and second positions, said mounting means including a retracting linkage for moving said cutting blade from said first position to said second position arranged rearwardly of the needles, an advancing linkage for moving said cutting blade from said second position to said first position forward of the needles, and means for controlling said actuating and retracting linkages;

whereby at the start of a sewing operation, said cutting blade is in said first position so as to cut the cloth in a position ahead of the needles, thereafter said retracting linkage is actuated and retracts said cutting blade to said second position rearward of the needles as the needles continue to sew the rows of stitching so that said cutting blade cuts behind the needles to form a slit opening in the cloth bordered by the rows of stitching on opposite sides thereof.

2. The sewing machine cutting attachment of claim 1 and wherein said means for controlling said actuating and retracting linkages comprises air cylinders connected to said actuating and retracting linkages and adapted to be actuated by means for controlling the operation of the sewing machine.

3. The sewing machine cutting attachment of claim 1 and wherein said means for releasably securing said cutting blade comprises a ball detent means including balls mounted in said needle chuck and adapted to engage apertures formed in said yoke when said cutting blade is in said first and second positions.

4. The sewing machine cutting attachment of claim 1 and wherein said cutting assembly mount further includes a push bar mounted to one side surface of said yoke in a position to be engaged by said actuating and retracting linkages for pivoting said yoke to move said cutting blade between said first and second positions.

5. The sewing machine cutting attachment of claim 1 and wherein said yoke includes a pair of spaced parallel side walls adapted to straddle said needle chuck, a knife support bar mounted between said side walls for supporting said cutting blade therebetween, and a pivot pin received through said needle chuck and engaging said side walls of said yoke to pivotally attach said yoke to said needle chuck.

6. A method of stitching and cutting a set-in pocket opening in a piece of cloth, comprising the steps of:

advancing the piece of cloth along a sewing path past a sewing needle and cutter assembly mounts including a needle chuck having a pair of sewing needles with a cutting blade positioned therebetween;

mounting a cutting blade on a support yoke and pivotally mounting the yoke to opposite sides of the needle chuck so that the blade moves between the needles to positions ahead of or behind the needle and is aligned with the sewing path;

reciprocating the needles and cutting blade into and out of the piece of cloth as the piece of cloth is advanced to commence a sewing operation wherein parallel lines of stitching are formed in the piece of cloth with a cut opening formed therebetween, with the leading edge of the cut opening starting ahead of the leading ends of the lines of stitching;

at an intermediate point during the sewing operation, intermittently engaging the yoke with an actuator means so as to cause pivoting of the cutting blade about opposite sides of the needle chuck and between the needles from an initial position forward of the needles along the cut opening to a second cutting position rearward of the needles so that the lines of stitching thereafter are formed ahead of the cut opening;

after the pocket opening has been formed, engaging the yoke with the actuator means to pivot the cutting blade to said initial cutting position forward of the needles.

7. The method of claim 6 and further including the step of locking the yoke with the cutting blade in said initial or second cutting positions.

8. The method of claim 6 and wherein the step of engaging the cutting blade with an actuator means comprises actuating a first air cylinder assembly for moving a retracting linkage rearwardly into engagement with a cutting blade mount, and urging the cutting assembly about a pivot axis to pivot the cutting blade to said second cutting position.

9. The method of claim 6 and wherein the step of engaging the yoke with the actuator means after the pocket opening has been formed comprises actuating a second air cylinder assembly for moving an advancing linkage forward into engagement with a cutting blade mount and urging the cutting blade mount about a pivot axis to pivot the cutting blade to said first cutting positions.

10. A cutting attachment for a sewing machine of the type including a housing, means for advancing a work product along a sewing path, and a needle bar for reciprocating above the sewing path, said cutting attachment comprising:

a needle chuck for mounting to and for reciprocating movement with the needle bar, said needle chuck including means for supporting a pair of sewing needles in side-by-side parallel relationship extending from said needle chuck toward the sewing path, a cutting assembly mount including a yoke straddling said needle chuck and pivotally mounted to opposite sides of said needle chuck about an axis disposed normal to the sewing path, a cutting blade supported by said yoke and extending downwardly from said yoke in a plane parallel to the sewing path and between said sewing needles, said cutting blade being pivotable with said yoke and with respect to said needle chuck between forward and rearward positions that place said cutting blade ahead of or behind the sewing needles along the sewing path, actuator means supported by said sewing machine housing for engaging said yoke to place said cutting blade alternately in one of said forward and rearward positions, and means carried by said needle chuck for engaging said yoke and releasably securing said blade in said forward or rearward positions.

11. The cutting attachment of claim 10 and wherein said needle chuck and said yoke include pivot attachment means for attaching said yoke to said needle chuck at different distances from the needle bar to change the path of movement of said cutting blade.

* * * * *